US005159316A

United States Patent [19]

Lazzara

[11] Patent Number: 5,159,316

[45] Date of Patent: Oct. 27, 1992

[54] CAPACITANCE CHANGE ARTICLE REMOVAL ALARM

[75] Inventor: Sal Lazzara, Bellingham, Wash.

[73] Assignee: Lazzara Electronics, Inc., Bellingham, Wash.

[21] Appl. No.: 562,253

[22] Filed: Aug. 3, 1990

[51] Int. Cl.[5] ..... G08B 13/14

[52] U.S. Cl. ..... 340/568; 307/119; 340/506; 340/529; 340/652; 340/666; 361/283; 361/291

[58] Field of Search ..... 340/568, 666, 506, 529, 340/652; 361/291, 283; 307/119, 112

[56] References Cited

U.S. PATENT DOCUMENTS

| | | | |
|---|---|---|---|
| 2,062,269 | 11/1936 | Knowles | 340/568 |
| 2,064,980 | 12/1936 | Kelly | 340/562 |
| 3,230,519 | 1/1966 | Metz et al. | 340/568 |
| 3,445,835 | 5/1969 | Fudaley | 340/568 |
| 3,824,460 | 7/1974 | Gustafson | 324/664 |
| 4,273,204 | 6/1981 | Gillen | 361/291 |
| 4,293,852 | 10/1981 | Rogers | 340/568 |
| 4,386,386 | 5/1983 | Akita | 361/291 |
| 4,581,677 | 4/1986 | Hruby eet al. | 361/283 |
| 4,816,802 | 3/1989 | Doerksen et al. | 340/529 |
| 4,836,033 | 6/1989 | Seitz | 361/291 |
| 4,994,793 | 2/1991 | Curtis | 307/119 |

*Primary Examiner*—Glen R. Swann, III

*Attorney, Agent, or Firm*—Hughes & Multer

[57] ABSTRACT

An object to be protected is placed on a compressible pad having upper and lower conductive plates, separated by a compressible dielectric. A sensing device is connected to the upper and lower plates to sense a first capacitance when the upper plate is compressed by presence of the object, and a change in capacitance when the object is removed so as to permit the dielectric layer to expand and change the capacitance. There is a time delay circuitry and other circuitry to alleviate the possibility of false alarms.

15 Claims, 7 Drawing Sheets

196
184
186
188
122
120
198
TO/FROM FIG. 6A
190
194
174
192

CAPACITANCE CHANGE ARTICLE REMOVAL ALARM

FIELD OF THE INVENTION

The present invention relates to an object protection system, and more particularly to such a system incorporating a detection pad that produces an electrical signal in response to a change in force or pressure exerted on the pad by the object, so as to prevent theft of the object.

BACKGROUND ART

Various object detection devices are known in the prior art, and one such device is shown in U.S. Pat. No. 4,293,852 (Rogers). This shows a detection device where there are metallic electrode strips 10 and 11 placed side by side and the article 15 which is to be protected from theft or other removal overlies the electrodes 10 and 11. The article 15 is metallic, or is arranged to incorporate metal at or near its base, for example, by a sticker or tag 5 which is attached to the article and is made of metal, or incorporates metal. There is a sensing circuit responsive to the capacitance present between the two conductors, this capacitance being modified by moving the metallic object (or the metallic tag attached to the object) away from the two strips 10 and 11.

U.S Pat. No. 4,836,033 (Seitz) shows a capacitive force measuring cell built up in sections to measure various forces. The capacitor surfaces are movable relative to each other against elastic resetting forces of the dielectric.

U.S. Pat. No. 4,386,386 (Akita) shows a capacitive sense loader that is in the form of coil spring elements. The change of capacitance between several coils, or between a coil and fixed element, is directed to a sensing device.

U.S. Pat. No. 4,273,204 (Gillan) shows a capacitive load cell that is used in a weighing scale or the like.

U.S. Pat. No. 3,445,835 (Fudaley) shows an article sensor in which an oscillator outputs to an antenna. If there is a change in the electronic environment near the antenna, a detectable frequency shift takes place and the detector is activated.

U.S. Pat. No. 3,230,519 (Metz) shows a capacitive article detector that makes use of a capacitance bridge to detect changes in the article presence.

U.S. Pat. No. 2,062,269 (Knowles) provides a detector in which a cold cathode tube grid is connected to a nongrounded metal article. If the article is moved, grounded, or a large body passes near, the voltage at the grid changes and the alarm is activated.

U.S. Pat. No. 2,064,980 (Kelly) shows a detecting system which detects changes in capacitance. There is a means for providing a constant frequency electrical supply, and a circuit including an antenna connected to and energized by the electrical supply. The rate of change of voltage across a portion of the circuit is detected.

U.S. Pat. No. 3,824,460 (Gustafson) shows a capacitive sensing system adapted for use in detecting the presence of a liquid on a floor in which a sensing probe comprises a pair of encased wires held essentially parallel to each other by a plurality of spaced webs which are an extension of casing of the wire. The probe is held flat on the floor over a considerable length so that leakage anywhere along the probe will result in capacitance change which may be sensed, and an appropriate alarm activated in response thereto.

SUMMARY OF THE INVENTION

The present invention is an apparatus to detect removal of an object from a location. There is a compressible detection pad comprising an upper conducting plate, a lower conducting plate, and an intermediate resilient dielectric layer which separates the upper and lower plates. The pad is characterized in that when an object is placed on the pad, at least a portion of the dielectric layer is compressed, and a removal of such object permits the dielectric layer to expand and change capacitance between the two plates.

There is pad detection and cable supervision monitoring means operatively connected to the pad by means of a cable. The monitoring means comprises first circuit means to detect a change of capacitance between the upper and lower plates by reason of compression or expansion of the dielectric layer, or by a change of capacitance due to presence of a person or other object. There is second circuitry means to detect a fault in the cable means. The monitoring means is arranged to provide an alarm signal in response to change of capacitance between the upper and lower plates or because of fault in the cable means.

Other features will become apparent from the following detailed description.

DESCRIPTION OF THE PREFERRED EMBODIMENT

The apparatus of the present invention, generally designated 10, comprises a detection pad 12, a pad and cable supervision monitor 14, and an alarm 16.

Figure 1:
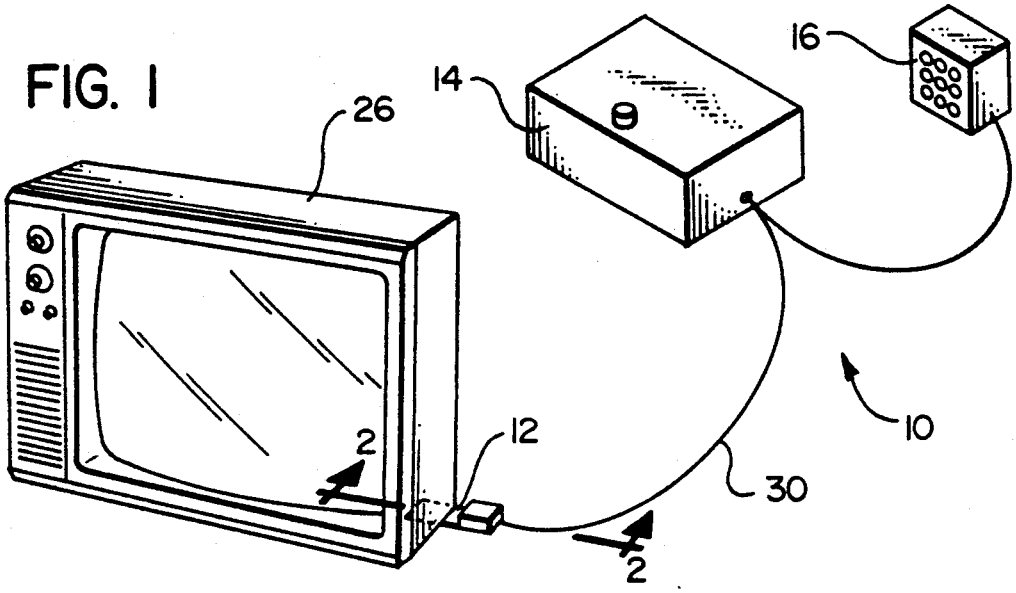
FIG. 1 is an isometric view showing the overall system of the present invention.
Figure 2:
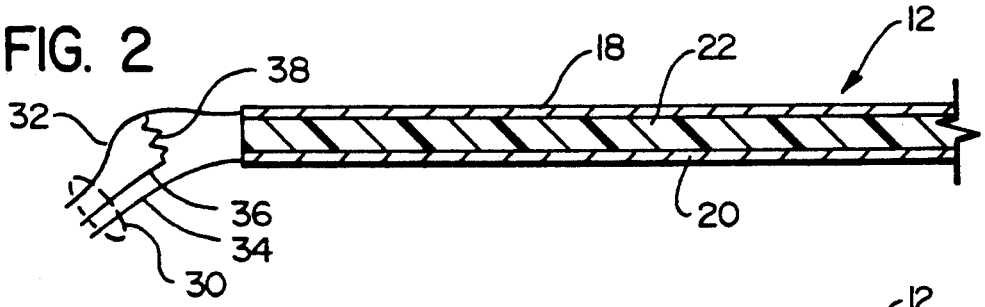
FIG. 2 is a cross sectional view of a first embodiment of the detection pad of the present invention.
Figure 3:
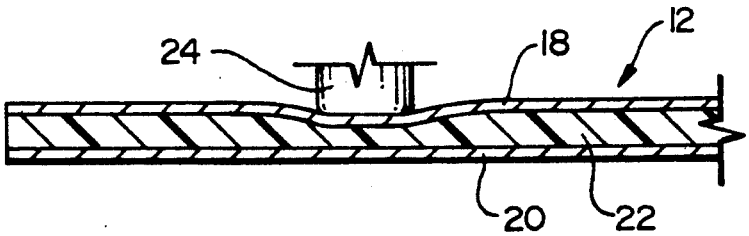
FIG. 3 is a view similar to FIG. 2, showing a portion of an object being placed on the detection pad.

A first embodiment of the detection pad 12, is shown in FIG. 1, and comprises a flexible upper conducting layer or plate 18, a lower conducting layer or plate 20, and a compressible dielectric layer 22 positioned between the two plates 18 and 20, the member 18-22 forming a capacitor. When an object, indicated schematically at 24, is placed on the detection pad 12, it will depress the flexible upper plate 18, as shown in FIG. 3, so as to compress the adjacent portion of the intermediate insulating layer 22. Thus, in the normal state, the intermediate layer 22 would be compressed because of the load 24 thereon, such as a television set 26, as shown in FIG. 1. When this load 24 is removed, the compressible layer 22 will move back to its uncompressed position, as shown in FIG. 2, and thus decrease the capacitance of the capacitor formed by the two layers 18 and 20 and the insulating layer 22 therebetween. This changing of capacitance is detected by the monitor 14 which in turn will transmit a signal to the alarm 16.

There is a cable 30 which connects the detecting pad 12 to the monitor 16. In the preferred embodiment shown herein, this cable comprises three wires, namely a sensing wire 32 connected to the upper layer 18, a ground wire 34 connected to the lower layer 20, and a cable tampering supervision wire 36. The wires 32 and 36 are connected to each other through an end-of-line resistor 38 located at the detection pad 12. In the event that we have several detection pads 12 connected one to the another, then this resistor 38 would be connected to the last detection pad 12 which is connected to the cable 30.

In terms of operation the aforementioned monitor 14 has three main functions. There is a capacitance change detection, cable supervision detection and the capacitance overload detection.

In the normal position, an object 24 is positioned on top of the detection pad 12, so as to compress the upper layer 18, as described above. The monitor 14 senses this particular capacitance level, and as long as this capacitance remains substantially unchanged, it will not sound an alarm. However, at such time as the capacitance of the detection pad 12 changes for a sufficient period of time (e.g. as long as 200 milliseconds), then the monitor 14 will respond to this and send an alarm signal to the alarm 16.

There is a second situation in which the monitor 14 will respond, and this will occur when another foreign object comes close to the pad 12 or object placed thereon in a manner to change the capacitance. For example, let it be assumed that a person is intending to remove the television set 26 from the pad 12, and this person attempts to foil the system by depressing the upper layer 18 at the same time that person is removing the object 24, with the person attempting to depress the upper layer or plate 18 in a properly timed maneuver so that the amount of depression of the intermediate layer 22 remains unchanged. The monitor 14 would then sense the presence of the person who himself has a capacitance between the plate 18 and ground, and would respond to this change of capacitance and then activate the alarm.

The monitor 14 is also able to sense a voltage drop across the resistor 38. To explain this briefly, the operation of the monitor 14 is such that the monitor 14 sends a pulsed current to the upper plate 18, and this pulsed current travels through the resistor 38 back to cable supervision detection circuitry in the monitor 14. The cable monitor 14 detects when there is a change in voltage level. This could occur, for example, by someone cutting the cable 30, so that there is no voltage sensed, or by someone possibly shorting out the resistor 38, or possibly simply grounding the resistor 38. When this occurs, the cable supervision circuit will also send a signal to the alarm 16.

The monitor 14 also responds to a very large increase in capacitance across the conducting layers 18 and 20. The reason for this is that the monitor 14 is made to be responsive to very small changes in capacitance (e.g. a change as small as 20 picofarads, with a capacitance load as high as 60,000 picofarads). This capacitance overload detection has two functions. First, it has a tamper proof function in that someone attempting to foil the system might connect a large capacitance between the two layers 18 and 20, so as to make the capacitance change detection circuitry of the monitor 14 inoperative. This would of course trigger the alarm. The second function is that it may be that the user would overload the system by connecting too many of the detecting plates 12 to the monitor 14, and under this circumstance, the alarm 16 would sound to indicate that the system is overloaded.

To summarize briefly the operation of this first embodiment of the present invention, the detection pad 12 will be placed on a surface, such as a table surface or a floor, and the object 24, such as a television set 26, computer terminal, etc. is placed on top of the detection pad 12. The cable 30 is connected from the detection pad 12 to the monitor 14, and the monitor 14 is in turn connected to the alarm 16. The circuitry of the monitor 14 is arranged so that it will balance itself, so that it will remain passive when the load imposed by the one or more objects 24 becomes constant. As described previously, when there is a force, resulting from the weight of the object 24, on the upper layer 18, the intermediate layer 22 becomes compressed, and thus has a capacitance of a certain predetermined level.

Let it now be assumed that a person attempts to remove one or more of the objects 24 from the detection pad 12. This decrease in force exerted on the top conducting layer 18 would result in an expansion of the intermediate layer 22 which would in turn change the capacitance between the two layers 18 and 20, this being sensed by the capacitance change detection circuitry of the monitor 14 which would in turn send an alarm. It should be pointed out that the capacitance change detection circuitry is in a fail safe mode so that in its normal mode of operation it transmits a constant signal to the alarm 16. It responds to a change in capacitance at the detector plate 12, and this results in an interruption of the signal to the alarm 16, which thus causes the alarm 16 to become activated.

Let it now be assumed that the person attempts to foil the system by imposing a force or weight on the upper layer 18 as the object 24 is being removed. As indicated previously the imposition of this force on the plate 18 in itself would cause a change of capacitance, since the person or other entity attempting to make this change would have a capacitance between the upper plate 18 and ground, and this also would be detected by the capacitance change detector.

If the person attempts to foil the system by tampering with the cable 30, as indicated previously, this would be detected by the cable supervision circuitry in the manner described above.

Figure 4:
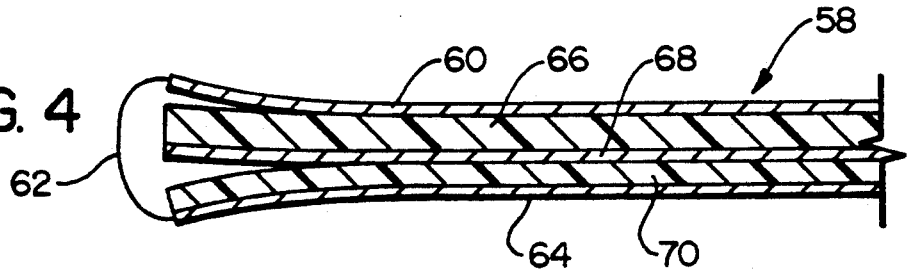
FIG. 4 is a sectional view similar to FIG. 2, but showing a second embodiment of the detection pad.

A second embodiment of the detection pad of the present invention is shown in FIG. 4 at 58. The second embodiment is particularly adapted for use in a situation where there is a load imposed on a very small area of the pad, such as a leg of a television set or the like.

In this particular embodiment, there is an upper plate 60 which acts as a touch detector, and this is electrically connected by a wire or other conductor 62 to a lower plate 64. Then there is a pressure amplifier plate 66 which comprises an upper insulating layer 66 which is reasonably stiff, and an intermediate conductive plate 68 positioned against, and connected to, the insulating plate 66. Then there is a second lower insulating plate 70 made of a resilient yielding material, and this plate 70 corresponds to the aforementioned insulating layer 22 of the first embodiment.

In the second embodiment, the plate 68 is connected to ground, while the two plates 60 and 64 are connected to the sensing cable 30. Also, the plate 68 is made with a large number of circular cut-outs, so that there is approximately fifty percent open area. These cut-outs could be, for example, about a quarter of an inch across and be positioned over the layer 68 in a regularly spaced pattern. The reason for this is to have an adequately large detection area of the pad 12, but maintain the capacitance at a relatively low level so that it will be properly responsive to the change in capacitance.

To describe the operation of this second embodiment, let us assume that a load 24 is placed on the top plate 60, which is relatively flexible. The force imposed at one location will bear against the pressure amplifier plate 66, which, as indicated earlier, is relatively stiff. Thus, the pressure amplified plate 66 will become depressed over a relatively larger area, possibly as much as ten to twenty times as great as the contact area of the object 24. This would cause a deflection of the layer 70 over a greater area, and thus have a relatively greater change in the capacitance between the plate 68 and the lower plate 64. In other respects, the operation of this pad 58 of the second embodiment is substantially the same as in the first embodiment, with respect to the manner to which it functions with the monitor 14 to provide the proper alarm signals.

Figure 5A:
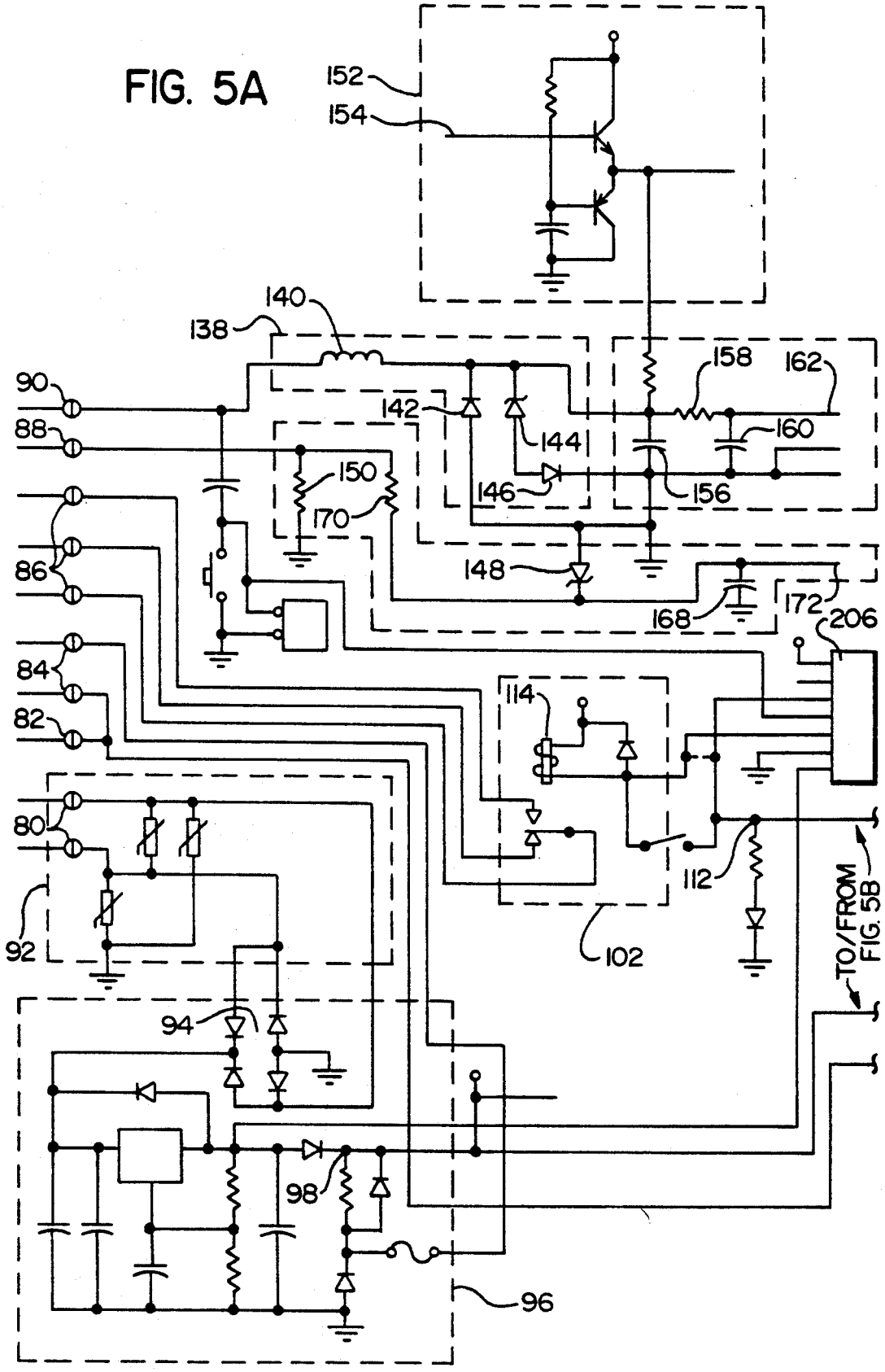
FIGS. 5A, 5B, 6A, 6B and 7 are five drawings showing the circuitry of the present invention.
Figure 5B:
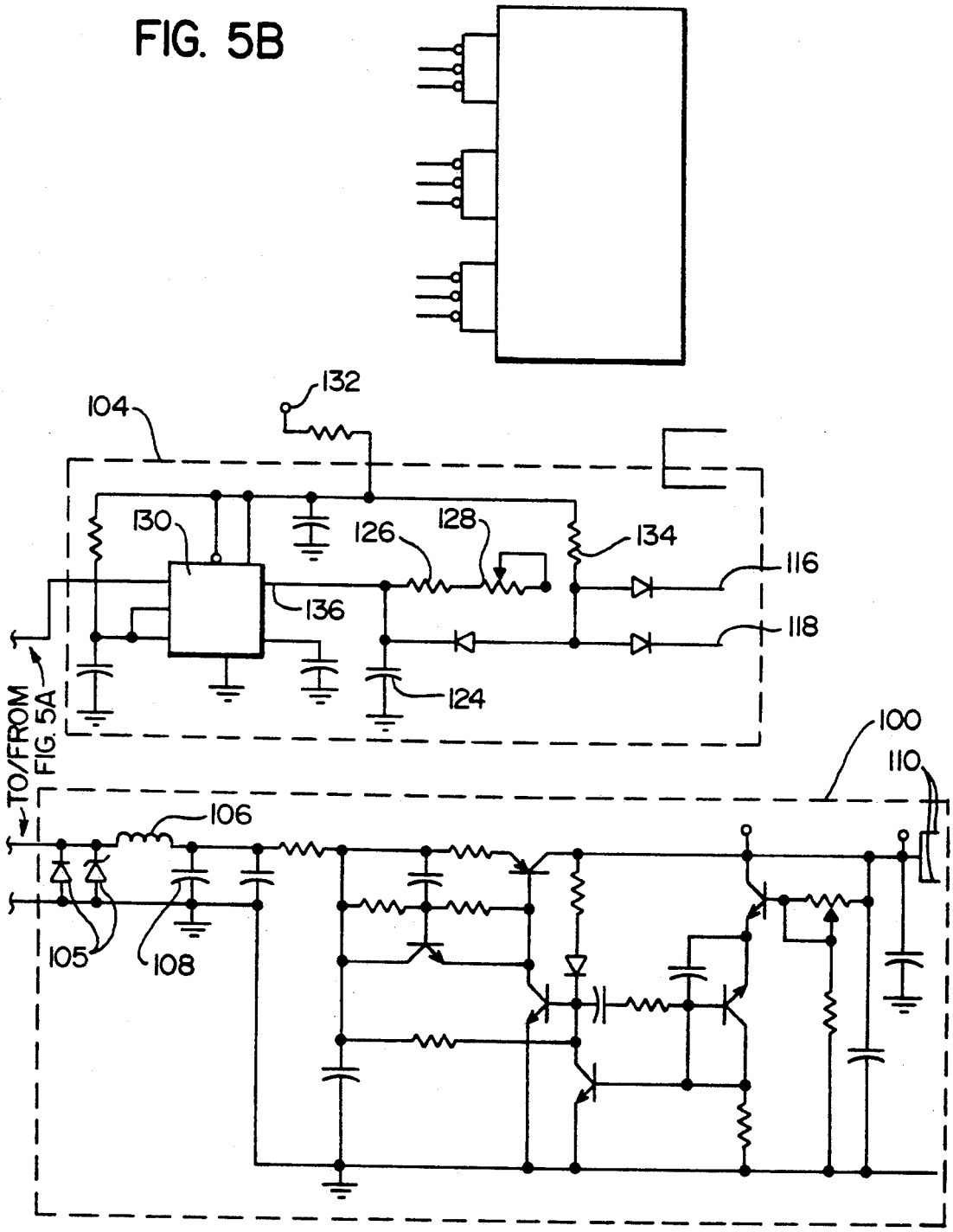

With reference to FIG. 5A, there is shown a set of terminals for the monitor 14. There are two terminals 80 which attach to a 16 volt A/C power source. There is a terminal 82 which attaches to earth ground and is thus connected to the ground wire 34. There are two rechargeable stand-by battery terminals 84 which, as their name implies, are attached to a stand-by battery. There are three relay alarm output terminals 86. The terminal 88 is the cable supervision terminal and thus connects to the wire 36. Finally, there is a sensing circuit terminal 90, and this attaches to the sensing wire 32. The leads from the terminals 80 go through the transient suppressor circuit 92, through the bridge rectifier 94, and thence into the regulator and battery charger 96. The output of the regulator and battery charger 96 is at the terminal 98, this being a 13.7 DC voltage supply. This is used to charge the battery which is attached to the terminals 84, and also supplies power to a 12 volt transient suppressor and 9 volt regulator 100 (FIG. 5B). Further, the output at 98 supplies power to an alarm relay. The lead 98 supplies power to the alarm relay circuit 102, and also to the alarm touch duration and pulse stretcher 104 (FIG. 5B).

The two diodes 105, the coil 106, and the capacitor 108 make up a transient suppressor. The remaining components included in the transient suppressor and 9 volt regulator 100 comprise a 9 volt regulator that is highly immune to line transients. The output of the transient suppressor and voltage regulator is at 110, and this output is a highly stable 9 volt supply.

The aforementioned alarm output circuitry 102 receives its power through the lead at 112, this being received from the aforementioned alarm touch duration and pulse stretcher 104. This alarm circuit 102 is normally energized, and it is de-energized in the alarm mode. Specifically, there is a relay 114 which is normally energized so as to maintain the relay closed. In the de-engergized state the relay 114 goes from one contact to the other, thus triggering the alarm.

The input to the alarm touch duration and pulse stretcher 104 is obtained through the two leads 116 and 118. The lead 116 is connected to a dual threshold comparator 120 which will be described hereinafter. The lead 118 is attached to the overcapacitance detector and the cable supervision circuit, these being collectively designated 122. The normal input to the connection 116 is a 12 volt input, and when this input drops to zero, it acts through the circuitry 104 to de-energize the alarm circuit 102 so as to set off the alarm. The same is true of the input 118 (FIG. 6), which normally receives a 12 volt input, and when this 12 volt input drops to zero, this acts through the circuitry 104 again to trigger the alarm circuit 102.

A significant feature in the present invention is the alarm duration circuitry, this being made up of the capacitor 124, the resistor 126, and the variable resistor 128. Also, the input from a timer 130 is part of the time duration circuit. During normal operation, the capacitor 124 would be charged to 12 volts. However, when the voltage at 116 drops to zero, the capacitor 124 discharges over a selected period of time, which in the preferred embodiment is about 200 milliseconds. This makes the system substantially false alarm free by eliminating the effect of transients, which could be generated from outside power sources, internally, or from other external sources.

There is a 12 volt source at 132 which connects to a resistor 134 to keep the input at 136 to the component 130 high. When the connection at 116 drops to zero volts, this pulls the connection 136 down to zero volts after the delay period of about 200 milliseconds (this being adjustable by means of the variable resistor 128), this causing the pulse stretcher 130 to de-activate the relay 114 for one second. Thus, this one second signal constitutes the alarm pulse which causes the alarm 16 to become active and provide an alarm signal.

Figure 6A:
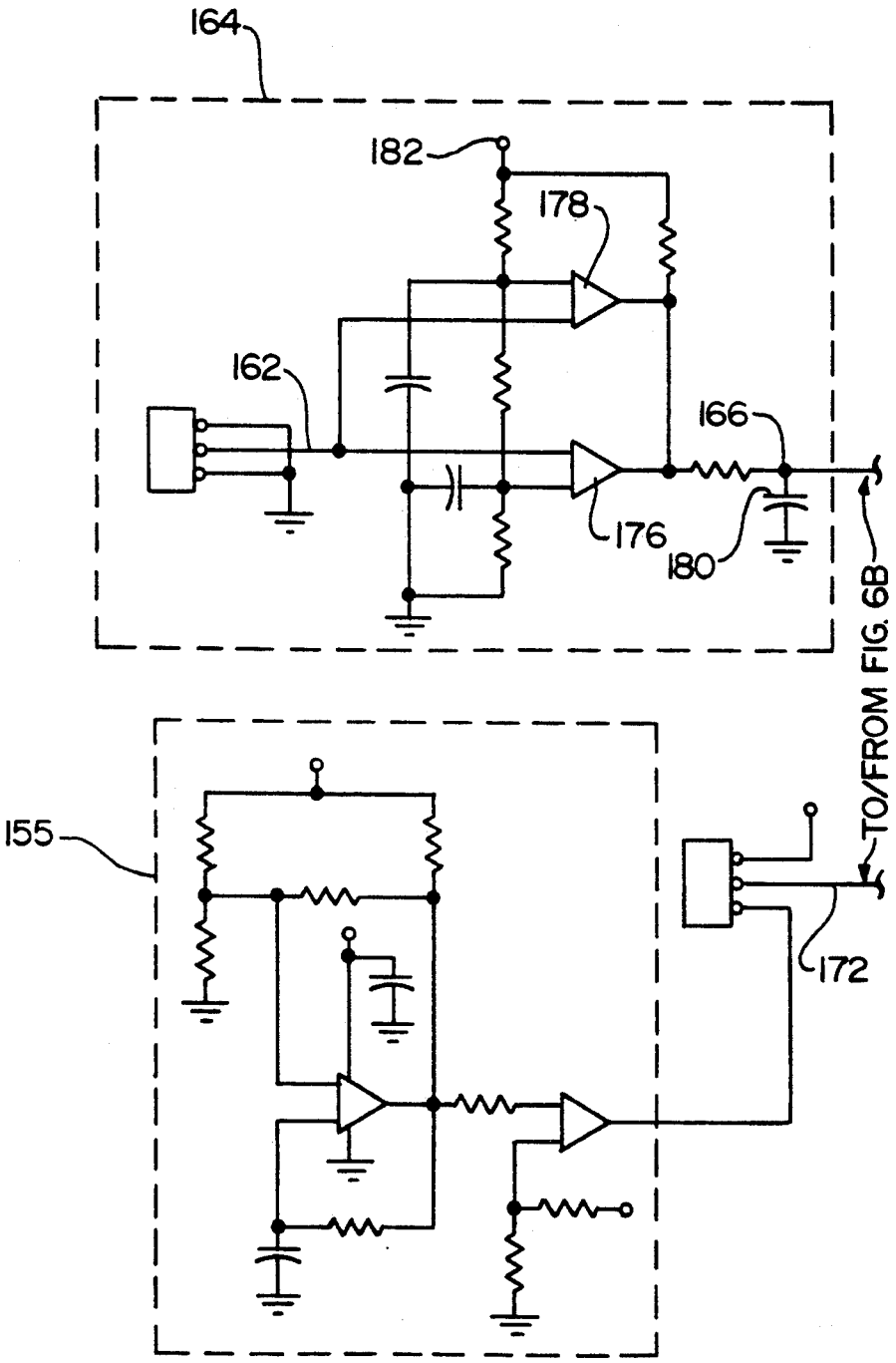
Figure 6B:
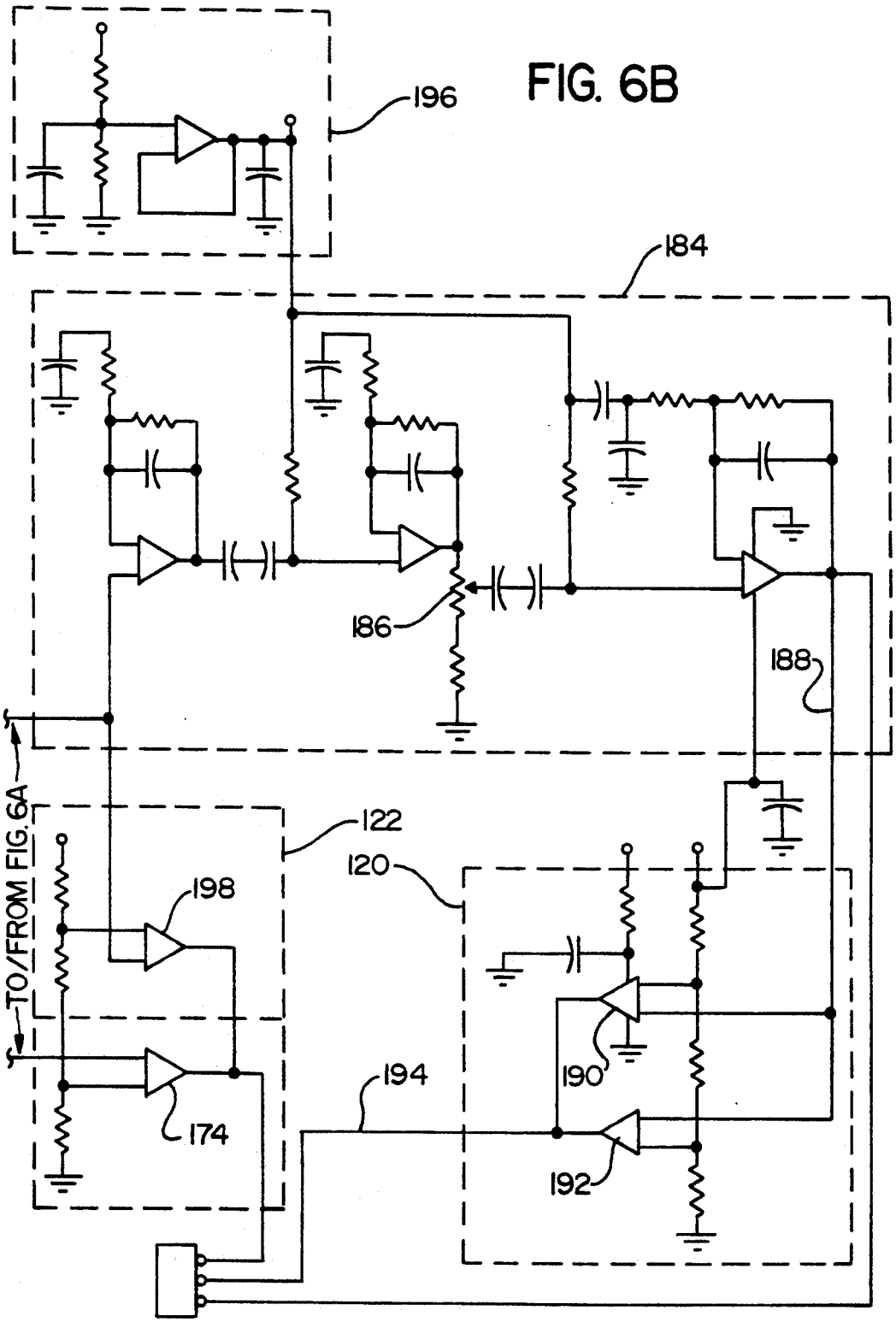

The tamper input 118 goes through the same time delay circuitry 124–128, and this is in response to either the overcapacitance detector or the cable supervision circuit, these being generally designated 122 (FIG. 6B). The reason that the two inputs 116 and 118 are maintained separately is that it may be desirable to disconnect only the input 116. For example, during the daytime people may be moving the objects 24, and it is desired not to trigger the alarm during that time.

There is an RFI transient voltage suppressor 138 (FIG. 5A), made up of the coil 140, and the diodes 142, 144 and 146. This removes the effect of the transients which would come in through the sensing line 32 and into the terminal 90. The diode 148 suppresses transients received in the cable supervision line 36 that is connected to the terminal 88. A resistor 150, in conjunction with the end-of-line resistor 38, functions to complete the circuit for cable line supervision.

There is a buffer/driver 152 which receives its input at 154 from an oscillator 155 (to be described hereinafter). This buffer/driver 152 supplies the pulsed square wave current through the terminal 90 and to the upper plate 12. The circuitry of the buffer/driver 152 is or may be conventional, so it will not be described in detail herein. Also, the oscillator 155 (FIG. 6A) is or may be conventional in the prior art, this being a short term, highly stable oscillator.

The capacitor 156 is an internal reference capacitor which is charged by the pulsed current from the buffer/driver 152. The rate of charge and discharge of this capacitor 156 is controlled by the amount of external capacitance placed on the sensing cable 32 by reason of change of capacitance of the detecting pad 12.

The resistor 158 and the capacitor 160 comprise a filtering circuit, the output of which at 162 leads to a total capacitance measurement circuit 164 (FIG. 6A). The output of the total capacitance measurement circuit 164 is at the lead 166, and this output is proportional to the change in capacitance as sensed from the sensing line 32.

With further reference to FIG. 5A, the capacitor 168 and the resistor 170 serve as a filter to receive the pulsed current from the terminal 88 that is connected to the cable supervision line 36, and to supply a steady DC output at the lead 172, which in turn supplies the input to a cable supervision comparator 174 (FIG 6B).

As indicated previously the output at the line 162 feeds the total capacitance measurement circuit 164. The total capacitance measurement circuit comprises a first low level comparator 176 and a high level comparator 178. The capacitor 180 is charged from a 9 volt source 182. The comparator 176 has its output go low below a predetermined voltage, so as to tend to discharge the capacitor 180 and the comparator 178 has its output go low when it senses from the line 162 a voltage above a certain level. To explain the operation of this, as indicated previously, the input to the line 162 is derived from the aforementioned reference capacitor 156 which is charging and discharging continuously. As the capacitance of the pad 12 changes, the duty cycle changes. Thus, if there is an object 24 placed on the pad 12 so as to increase its capacitance, the duty cycle increases, and the rate of change on the capacitor 156 will become slower. The effect of this is that the time period between which the comparator 176 is deactivated and the comparator 178 is activated becomes longer, the net effect of this being that the voltage on the capacitor 180 increases.

The output at 166 from the capacitor 180 is directed into the capacitance change bandpass amplifier 184 (FIG. 6B), which is adjustable by means of the variable resistor 186. This adjustment is to adjust the amount of capacitance needed to sound an alarm. More specifically, this amplifier 184 responds to signals as low as one millivolt between 0.3 and 4 Hz. The output from the amplifier 184 is at the lead 188, and this output is normally 4.5 volts. A change of approximately 20 picofarads will cause the 4.5 volt output to either increase or decrease by as much as 1.5 to 2 volts, and this change will be detected by the dual threshold alarm comparator made up of the two comparators 190 and 192. The output of the dual threshold comparator 120 is at 194, and this is connected directly to the aforementioned line 116. The line 194 normally will remain at a 12 volt level, this voltage being imposed by the voltage source 132 (FIG. 5B), until there is a sufficient change in capacitance to activate either of the comparators 190 or 192, which when activated pull the voltage on the line 116 down to zero voltage, thus activating the duration circuit 124–128.

There is a 4.5 voltage regulator 196, and this provides a 4.5 regulating voltage to the capacitance change bandpass amplifier 184. This regulator 196 is or may be conventional.

The output at 166 (which is responsive to total capacitance in the system) is also directed to the over capacitance detector which comprises a comparator 198. When there is too much capacitance, this goes over the threshold level of the comparator 198 causing the comparator 198 to go low, and with the output of the comparator 198 connected to the tamper connecting line 118, causes this line 118 to go low to provide the tamper alarm signal. As indicated previously, the function of this is to prevent someone from deactivating the system by adding a large capacitance into the system, so as to desensitize the system so that it cannot respond to the small changes in capacitance.

Figure 7:
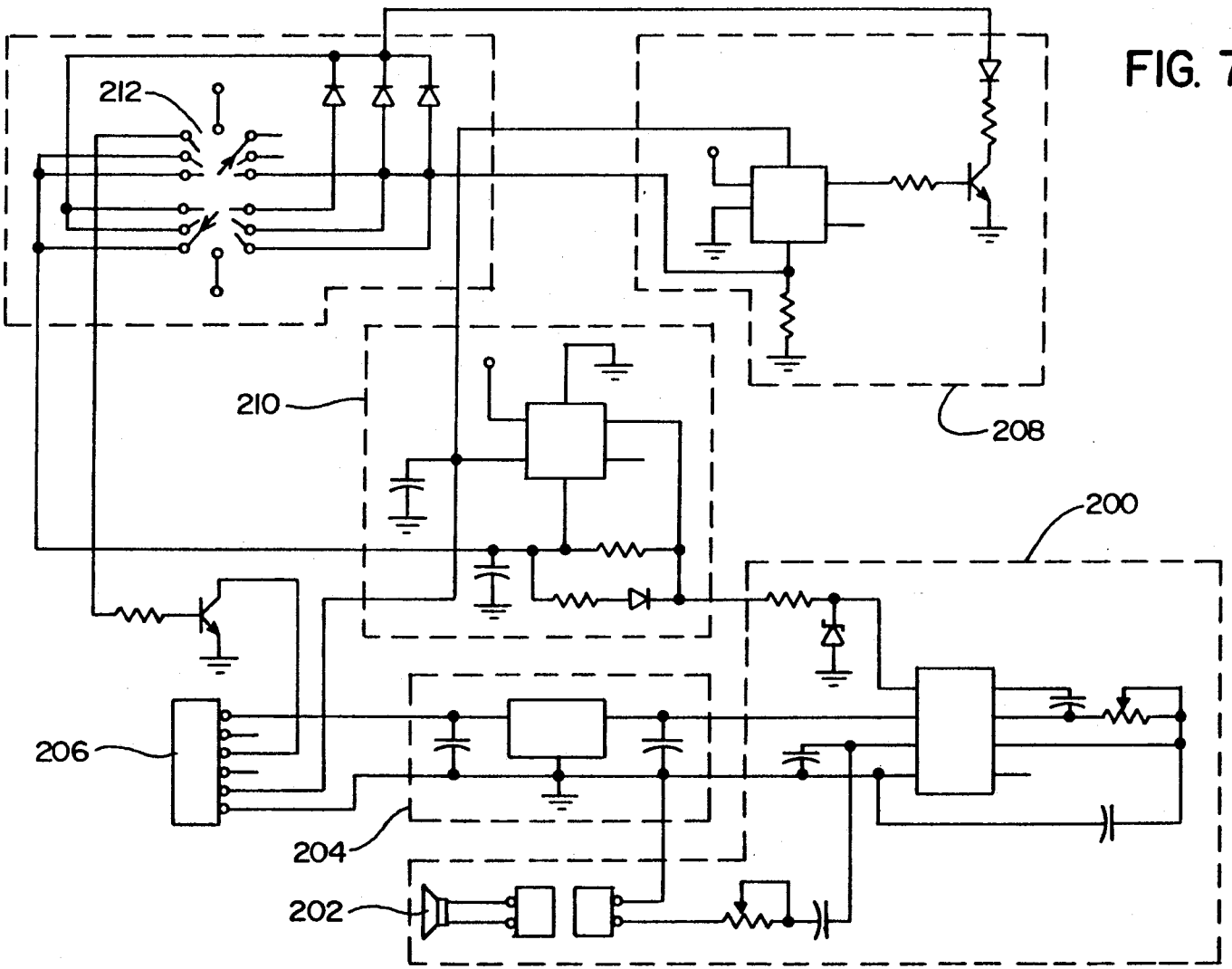

FIG. 7 shows a chime circuit 200 which drives an internal speaker 202. An 8 volt regulator 204 supplies power to the chime circuit 200 which drives the speaker 202. The chime circuit 200 derives its power from the input power connector 206 (see FIGS. 5A and 7).

The connector 206 also supplies power to the alarm memory 208 and to the alarm one shot circuit 210. The alarm memory 208 responds to an alarm signal to turn on a light which remains on until it is manually reset by a mode select switch 212. The function of the alarm one shot circuit simply controls the chime circuit 200.

Figure 8:
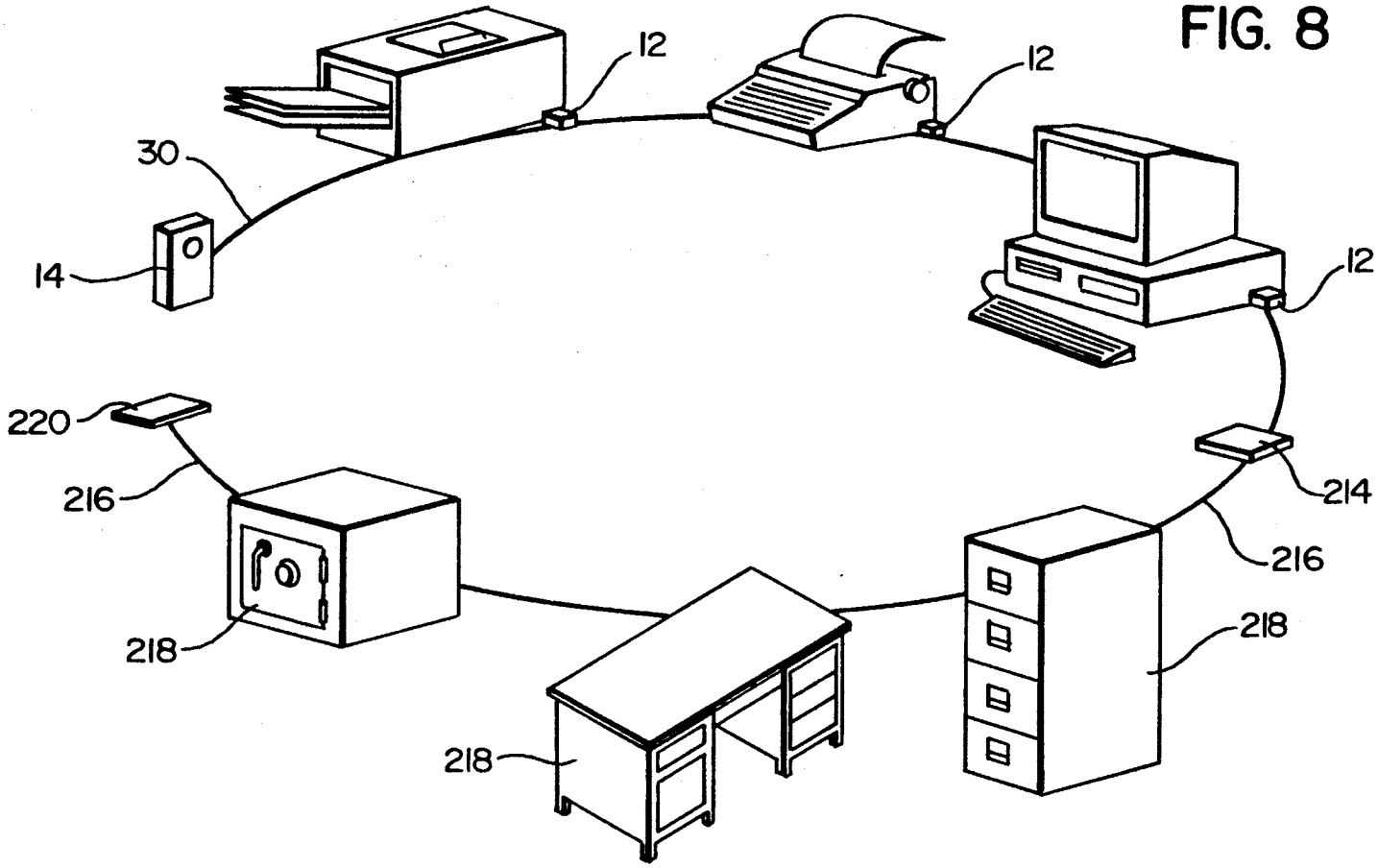
FIG. 8 is a schematic view illustrating a typical installation of the present invention.

FIG. 8 shows an installation for a typical system. The pad and cable supervision monitor 14 is connected to the cable 30 which is in turn attached to a plurality of pads 12 connected in series, this being done so that the cable supervision circuitry would function properly. The cable leading from the last pad 12 is in turn connected to a wiring block 214, and the cable 216 leading from the block 214 does not have the ground line (since it is not necessary from this point on), but does have the sensing line 32 and the cable supervision line 36. The sensing line 32 in the cable portion 216 is electrically connected to each of the metal objects indicated at 218, these being, for example, a file cabinet, a desk, and a safe, or any other metallic object. This is to detect a change of capacitance because of the presence of a person or for some other reason. The cable 216 continues on to an end block 220 which contains the end-of-line resistor 38 for cable supervision.

It is obvious that various modifications could be made to the present invention without departing from the basic teachings thereof.

What is claimed is:

1. An apparatus to detect removal of an object from a location, said apparatus comprising:

a. a compressible detection pad comprising an upper conducting plate, a lower conducting plate, and an intermediate resilient dielectric layer which separates the upper and lower plates, with said pad being characterized in that when an object is placed on said pad, at least a portion of the dielectric layer is compressed, and a removal of such an object permits the dielectric layer to expand and change capacitance between the two plates;

b. pad detection and cable supervision monitoring means operably connected to said pad by means of a cable, said monitoring means comprising first circuit means to detect a change of capacitance between said upper and lower plates by reason of compression or expansion of said dielectric layer, or by change of capacitance due to presence of a person or other object, and second circuitry means to detect a fault in said cable means, said monitoring means being arranged to provide an alarm signal in response to change in capacitance between said upper and lower plates or because of fault in said cable means.

2. An apparatus as recited in claim 1, further comprising capacitance overload detection means for detecting a relatively large increase in capacitance load, the alarm signal being provided in response to such relatively large increases in capacitance load.

3. An apparatus as recited in claim 1, in which:

a. the cable comprises at least a first conductor connected to the upper plate and a second conductor, where a resistor is electrically connected between the first and second conductors at the end of the cable that is connected to the upper plate; and b. the second circuitry means comprises means electrically connected to the second conductor for detecting a change in the voltage level across the resistor.

4. An apparatus as recited in claim 1, in which the compressible detection pad further comprises means for distributing the force applied by the object over a relatively larger area to cause a greater capacitance change between the first and second detecting plates.

5. An apparatus as recited in claim 1, in which the first circuit means provides the alarm signal a predetermined time period after detecting a capacitance change.

6. An apparatus as recited in claim 1, in which the first circuit means comprises:

a. third circuit means for generating a pad capacitance signal corresponding to the capacitance between the two plates; and b. fourth circuit means for determining whether the pad capacitance signal changes;

whereby the fourth circuit means generates the alarm signal when the pad capacitance signal changes by more than a predetermined amount.

7. An apparatus as recited in claim 6, in which the third circuit means comprises:

a. means for generating a pulsed pad signal based on the voltage across the two plates, where the duty cycle of the pulsed pad signal corresponds to the capacitance between the two plates; and b. means for so charging a capacitor that the voltage across the capacitor corresponds the duty cycle of the pulsed pad signal;

whereby the voltage across the capacitor is the pad capacitance signal.

8. An apparatus as recited in claim 7, in which the apparatus further comprises means for generating a pulsed input signal and applying this pulsed input signal to the upper plate.

9. An apparatus as recited in claim 6, in which the fourth circuit means comprises:

a. a first comparing circuit means for generating the alarm signal when the pad capacitance signal drops by a first predetermined amount; and b. a second comparing circuit means for generating the alarm signal when the pad capacitance signal rises by a second predetermined amount.

10. An apparatus as recited in claim 6, further comprising capacitance overload detection means for determining whether the pad capacitance signal is greater than a predetermined voltage level.

11. A method of detecting removal of an object from a location, comprising the steps of:

a. providing a compressible detection pad comprising an upper conducting plate, a lower conducting plate, and an intermediate resilient dielectric layer which separates the upper and lower plates;

b. placing the pad at the location;

c. placing the object on the pad to compress the pad; and d. generating an alarm signal when the compression or expansion of the compressible detection pad causes the capacitive load between the upper and lower plates to change by a predetermined amount, the step of generating the alarm signal further comprising the steps of:

i. measuring a pad capacitance signal corresponding to the capacitance between the two plates by generating a pulsed pad signal based on the voltages across the two plates, the duty cycle of the pulsed pad signal corresponding to the capacitance between the two plates, and so charging a capacitor that the voltage across the capacitor corresponds to the duty cycle of the pulsed pad signal, whereby the voltage across the capacitor is the pad capacitance signal, and ii. determining whether the pad capacitance signal changes by the predetermined amount.

12. A method as recited in claim 11, in which the alarm signal is generated a predetermined time period after the capacitance change is detected.

13. A method as recited in claim 11, further comprising the steps of detecting a relatively large increase in capacitance load, the alarm signal being provided in response to such relatively large increases in capacitance load.

14. An apparatus as recited in claim 11, in which the step of determining whether the pad capacitance signal changes by the predetermined amount comprises the steps of:

a. generating the alarm signal when the pad capacitance signal drops by a first predetermined amount; and b. generating the alarm signal when the pad capacitance signal rises by a second predetermined amount.

15. An apparatus as recited in claim 14, further comprising capacitance overload detection means for determining whether the pad capacitance signal is greater than a predetermined voltage level.

* * * * *